United States Patent [19]

Ohki et al.

[11] Patent Number: 4,936,948

[45] Date of Patent: Jun. 26, 1990

[54] METHOD FOR PRODUCING A LIGHT SENSITIVE BODY FOR ELECTRONIC PHOTOGRAPHY USE

[75] Inventors: Yasushi Ohki; Toshinao Ishizone, both of Nagano, Japan

[73] Assignee: Fuji Electric Co., Ltd., Kawasaki, Japan

[21] Appl. No.: 406,459

[22] Filed: Sep. 13, 1989

[51] Int. Cl.[5] ..... C23F 1/00; B44C 1/22

[52] U.S. Cl. ..... 156/645; 156/665; 252/79.2; 252/79.5

[58] Field of Search ..... 156/645, 656, 659.1, 156/665; 252/79.2, 79.5; 430/278, 290, 526, 950

[56] References Cited

U.S. PATENT DOCUMENTS 4,292,388 9/1981 Ikeda et al. ..... 156/665 X 4,670,095 6/1987 Negishi ..... 156/904 X

*Primary Examiner*—William A. Powell

*Attorney, Agent, or Firm*—Brumbaugh, Graves, Donohue & Raymond

[57] ABSTRACT

The present invention relates to a method for producing a light sensitive body for use in electronic photography copiers and printers, wherein the surface of a substrate comprising aluminum as the main constituent is made flat and smooth by mechanical processing, subjected to further etching treatment, and a light sensitive layer is formed thereon. This light sensitive body is used in connection with an optical toner concentration sensor. This toner concentration sensor, along with a toner concentration controlling mechanism, will enable copied picture images to have constant image concentration without the occurrence of base fog.

7 Claims, 4 Drawing Sheets

METHOD FOR PRODUCING A LIGHT SENSITIVE BODY FOR ELECTRONIC PHOTOGRAPHY USE

This application claims priority under Japanese Patent Application No. 63-230658 filed on Sept. 14, 1988.

BACKGROUND OF THE INVENTION

The present invention relates to a method for producing an improved light-sensitive body for use in connection with an optical toner concentration sensor equipped in electronic photography copiers and printers. The light sensitive bodies so produced interact with optical toner sensors to allow better sensing of toner concentration, and thus copied picture images to have constant image concentration without the occurrence of base fog.

Conventionally, light sensitive bodies have been used in electrophotography in connection with optical toner concentration sensors. These light sensitive bodies comprise photoconductive substances on conductive substrates. The surfaces of the conductive substrates must be smooth and must be appropriately made rough so that a light sensitive layer can strongly adhere thereon. Generally, the conducting substrate comprises aluminum as the main constituent. The conventional methods used to process the surface of the aluminum substrate are as follows:

(a) mirrorlike surface finishing by scrape processing with a diamond bite;

(b) Grind finishing with a grind stone; and (c) Tape polish finishing with a grinding tape.

After these surface processing methods are performed on the aluminum substrate, the substrate is treated with a nitric acid solution to form an oxide thin film thereon. The result is a light sensitive body to be used in connection with an optical toner concentration sensor in electrophotography. Light is reflected off the light sensitive body (aluminum substrate surface) and through a surrounding layer of toner so that a toner concentration controlling mechanism receives this reflected light as diminished by the toner layer, and is thereby directed to release toner if required.

When such conventional methods of processing the aluminum substrate are employed, however, the light reflected off the surface of the light sensitive body (the surface of the aluminum substrate) is dispersed to a large extent. Since the light reflection is dispersed on the surface of the aluminum substrate, the amount of reflected light that passes through the toner and to the toner concentration controlling mechanism is not an accurate measurement of the amount of toner in the printer. Therefore, the controlling mechanism can not preserve the toner concentration constant, and a change of picture image concentration results.

It is an object of the present invention to provide a method of producing a light sensitive body for use in electronic photography equipment, which accurately detects variations in toner concentration by means of an optical toner concentration sensor. The result is good quality picture image with constant concentration.

SUMMARY OF THE INVENTION

In accordance with the present invention, a light sensitive body is produced by first smoothly finishing the surface of a substrate comprising aluminum as the main constituent by mechanical processing, and then subjecting the substrate to etching treatment. In the etching treatment, either alkaline aqueous solution or acidic aqueous solution is used, and the $R_{max}$ of the surface of the aluminum substrate after etching treatment is from 2.0 μm to 4.0 μm. On the surface of this substrate, a light sensitive layer is then formed.

The etching treatment removes the exterior portion of the substrate which has become denatured due to the stress of the mechanical processing. The surface of the substrate thus becomes uniform so as to cause very low dispersion of the light reflection intensity.

BRIEF DESCRIPTION OF THE DRAWINGS

FIG. 5(*a*) is a circuit diagram of an example of the sensor and FIG. 5(*b*) is a diagram for showing the principle of the method for detecting the toner concentration by means of the sensor.

DETAILED DESCRIPTION OF THE INVENTION

According to the present invention, the above-described object can be attained by pretreating the surface of the substrate prior to formation of the light sensitive layer. Thus, after finishing the surface of a substrate comprising aluminum as the main constituent so that it is flat and smooth and in the required shape by mechanical processing, the surface is further subjected to etching treatment by means of an alkaline aqueous solution or an acidic aqueous solution to make the surface height $R_{max}$ from 2.0 μm to 4.0 μm. Then, a light sensitive layer is formed on the surface of this substrate.

The surface of an aluminum substrate is subjected to mechanical treatment until it becomes flat and smooth. It is denatured on the most exterior surface due to the stress in the processing. This causes dispersion of light reflection intensity on the surface of an aluminum substrate. When the surface of the aluminum substrate is subjected to an etching treatment by means of an alkaline aqueous solution or an acidic aqueous solution in accordance with the invention, the denatured exterior part is removed, leaving the surface of the substrate uniform. The substrate thus has very low dispersion of the light reflection intensity.

The etching treatment preferably gives rise to a surface having a maximum roughness $R_{max}$, of from 2.0 μm to 4.0 μm. When $R_{max}$ of the aluminum substrate after etching treatment is less than about 2.0 μm, the amount of etching is too little to remove the denatured portion of the substrate and the dispersion in the light reflection intensity is not decreased. Also, when $R_{max}$ becomes more than about 4.0 μm, the surface roughness is too large, and the light sensitive layer formed on the aluminum substrate does not become uniform, and defects appear on the picture image obtained.

the light reflection intensity of the surface of the aluminum substrate has extremely little dispersion. Therefore, it is possible to accurately detect the variation of the light sensitive body. When the light sensitive body according to the present invention is used in connection with an optical toner concentration sensor and a toner controlling mechanism in electronic photography equipment, good quality copied picture images or printed letters having constant concentration are obtained.

Figure 5A:
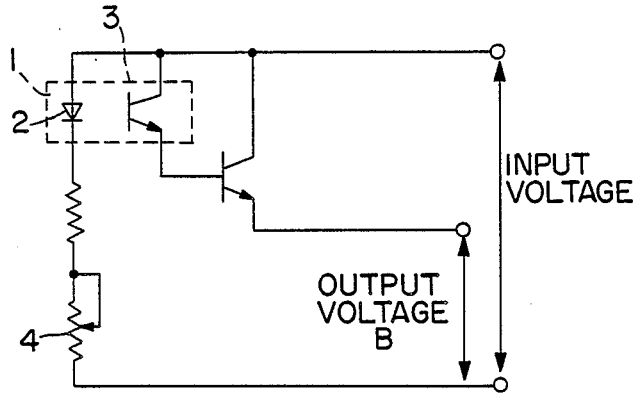
FIG. 5 is a diagram relating to the optical toner concentration sensor.
Figure 5B:
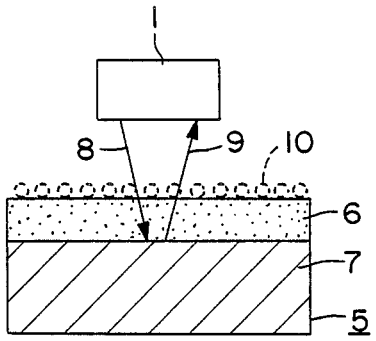

FIG. 5 shows a circuit diagram of an example of the optical toner concentration sensor as the constructive element of such a mechanism, and the principle of the method for detecting the toner concentration. FIG. 5(*a*) is a circuit diagram of the sensor, and number 1, encircled with a dotted line, shows a photosensor comprising a LED 2 and a photo-transistor 3. Number 4 denotes an input adjusting resistor. FIG. 5(*b*) shows the principle of detecting the toner concentration by the Input Voltage A, input in the sensor consisting of the circuit shown in FIG. 5(*a*). The light emitted from the LED 2 of the photosensor 1 therein is irradiated on the surface of the light sensitive body 5, and the impinged light 8 is transmitted through the light sensitive layer 6 and reflects off the surface of the aluminum substrate 7. The reflected light 9 is received in the phototransistor 3 of the photosensor 1. Next, the output of the phototransistor 3 which received the reflected light in such a manner as described above, is detected as the Output Voltage B of the sensor. When the toner 10 adheres on the surface of the light sensitive body 5 as shown with circles of dotted lines, the reflected light 9 becomes weak corresponding to the concentration of the toner adhered, and the output voltage B becomes lowered. The variation of the toner concentration is known from this variation in the output voltage. The toner supply amount from the toner supply equipment can thus be controlled to preserve the toner concentration constant, and to prevent the change of the picture image concentration. The output voltage may be standardized with an established output voltage obtained when the toner of a required standard concentration has adhered on the surface of the light sensitive body.

As described above, the toner concentration controlling mechanism, by way of the light sensitive body and the optical toner concentration sensor, utilizes the light reflected from the surface of the aluminum substrate of the light sensitive body. The control is effected on the premise that the reflection on the surface of the aluminum substrate is constant.

Figure 6:
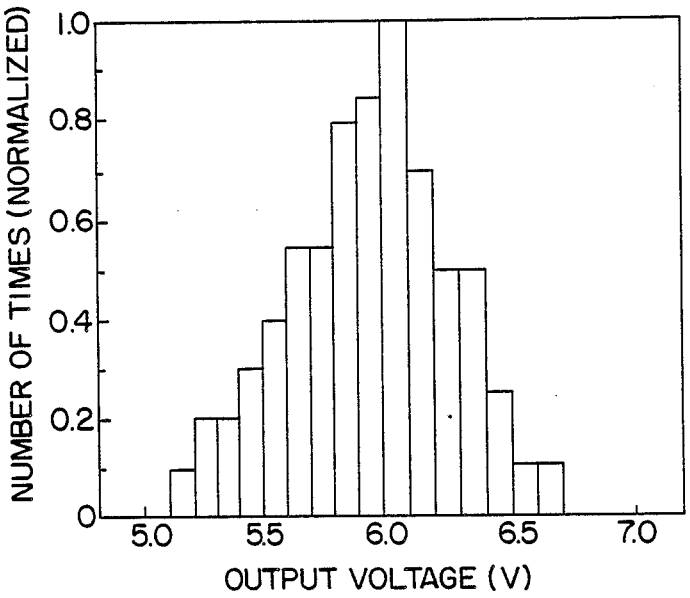
FIG. 6 is a distribution diagram of the output voltage of the optical toner concentration sensor on the conventional light sensitive body.

FIG. 6 shows the distribution of the output voltages of respective light sensitive bodies measured in the case where the output voltage of the light sensitive body as the standard is adjusted at 6 V. The output voltage is dispersed in a wide range of 1.6 V, from 5.1 V to 6.7 V. Such dispersion is due to the dispersion of the light reflection intensity on the surface of the aluminum substrate. When a light sensitive body reflects light with a dispersion as described above, the variation of the toner concentration can not be accurately detected with an optical toner concentration sensor. Therefore, appropriate toner supply cannot be conducted, and the picture image obtained is dispersed.

EXAMPLES

Example 1

Figure 1:
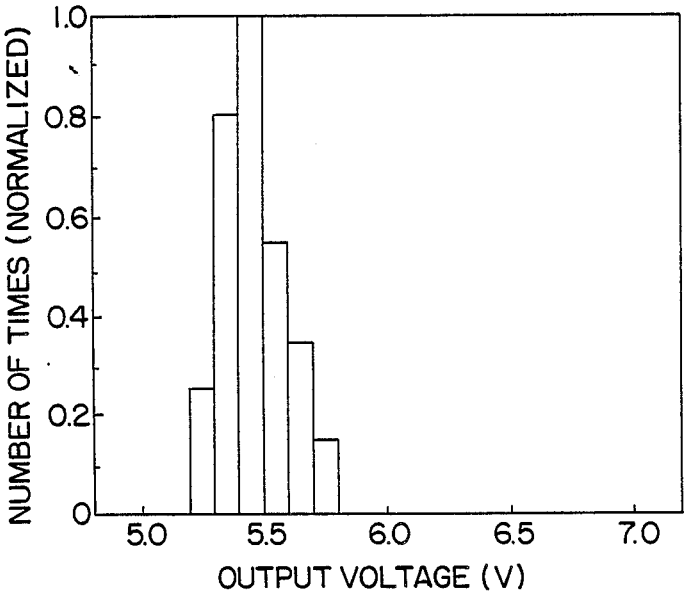
FIG. 1 is a distribution diagram of the output voltage of the optical toner concentration sensor on the light sensitive body produced by using the aluminum substrate subjected to the etching of the KOH aqueous solution as an Example of the present invention.
Figure 2:
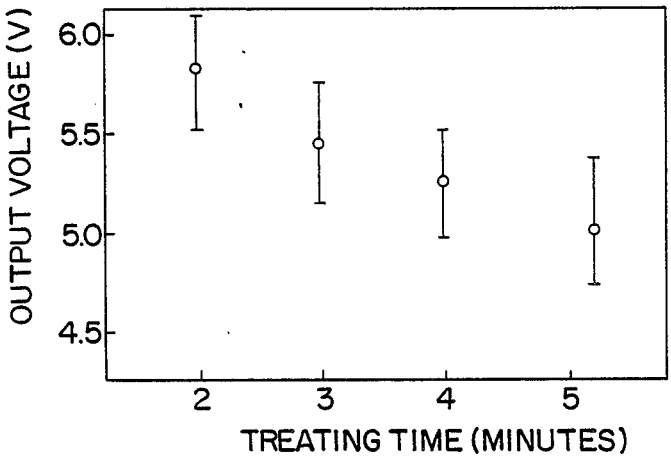
FIG. 2 is a line figure for showing the relationship between the KOH aqueous solution etching treatment time and output voltage of the optical toner concentration sensor.

After finishing the surface of a drum-like aluminum substrate by the scraping process using a diamond bite, such that the surface became uniformly flat and smooth to have the $R_{max}$ of about 1.0 μm, it was etched with a 3% by weight of a KOH aqueous solution at a liquid temperature of 40° C. for 3 minutes. The $R_{max}$ of the surface of the aluminum substrate after etching was in the range of 2.5 μm to 3.5 μm. A Se-As system alloy was vacuum evaporated on the surface of this aluminum substrate to form a light sensitive layer and to make it a light sensitive body. On the light sensitive body thus formed, output voltage was examined at the input voltage of 10 V by use of the optical toner concentration sensor shown in FIG. 5. The result is shown in FIG. 1. The output voltage value was 5.4 V on the average, and its dispersion was 0.6 V, which was decreased in comparison with the value of the conventional one of 1.6 V. The results of the examination of the output voltage of the above-described sensor on the light sensitive body using the aluminum substrate obtained by changing the time of etching treatment with this treating liquid are shown in FIG. 2. With the prolongation of the treating time, the output value decreased, but the width of the dispersion thereof was not changed from about 0.6 V.

Example 2

Figure 3:
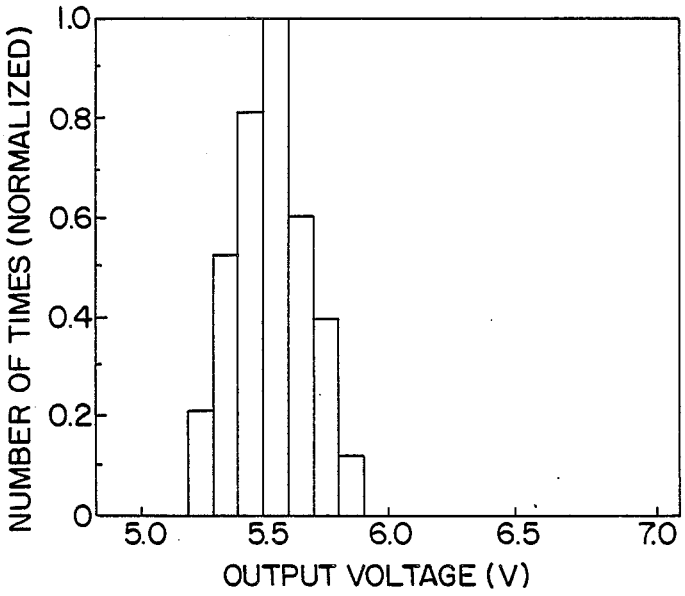
FIG. 3 is a distribution diagram of the output voltage of the optical toner concentration sensor on the light sensitive body produced by using the aluminum substrate subjected to the etching of the $H_2SO_4$ aqueous solution as the different Example of the present invention.
Figure 4:
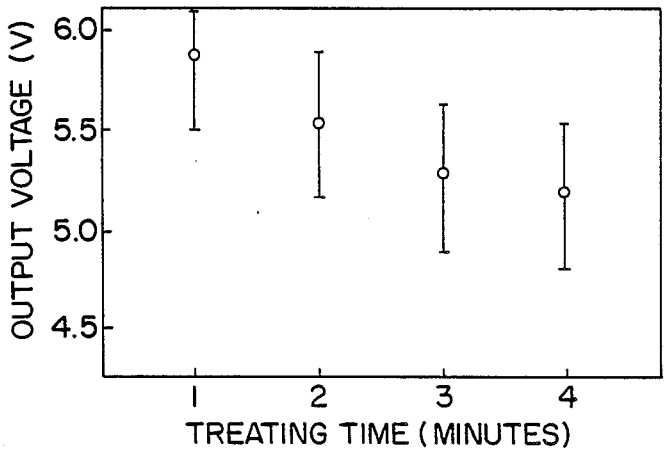
FIG. 4 is a line figure for showing the relationship between the $H_2SO_4$ aqueous solution etching treatment time and the output voltage of the optical toner concentration sensor.

The surface of the aluminum substrate was subjected to the same mechanical processing as in Example 1. It was etched with a 40% by weight H acid aqueous solution at a liquid temperature of 60° C. for 3 minutes. The $R_{max}$ of the surface of the aluminum substrate obtained was in the range of 2.5 μm to 3.5 μm. A Se-As system alloy was vapor deposited on the surface of the aluminum substrate; to form a light sensitive layer thereon, and a light sensitive body was made. The results of the examination of the output voltage of the sensor on the light sensitive body similar to Example 1, are shown in FIG. 3. The output voltage value was 5.5 V in average, and the dispersion thereof was 0.7 V, which was reduced to a large extent in comparison with the conventional one, similar to Example 1. The output voltage was examined on the light sensitive body using the aluminum substrate obtained by changing the etching time with this treating liquid, as shown in FIG. 4. Although the output voltage decreased as treating time was prolonged, its dispersion had almost no change from about 0.7 V.

The KOH aqueous solution is effective in that the surface of an aluminum substrate having the $R_{max}$ of more than 2 μm and less than 4 μm is obtained at the concentration of 2% to 10% by weight, and at the liquid temperature of 20° C. to 60° C. with the treating time for 1 to 5 minutes. A light sensitive body in which the dispersion of the output voltage of the above-described sensor is about 0.6 V can be obtained. Also, the $H_2SO_4$ aqueous solution is effective in that the surface of an aluminum substrate having the $R_{max}$ of more than 2 μm and less than 4 μm is obtained at the concentration of 20% to 50% by weight, and at the liquid temperature of 50° C. to 80° C., in the treating time for 1 to 5 minutes. A light sensitive body in which the dispersion of the output voltage value of the above-described sensor is about 0.7 V can be obtained. Further, the output voltage value can be controlled to a certain extent by changing the conditions such as the treating time and the like.

When the dispersion of the output voltage is settled to less than about 0.7 V, the necessity of adjusting the input of the sensor becomes almost none.

The liquid for use in the etching treatment is not limited to KOH aqueous solution and $H_2SO_4$ aqueous solution. Also, the mechanical processing of the aluminum substrate before the etching treatment is not limited to the scraping process by using a diamond bite. However, there is the necessity of changing the finished state of the surface of the aluminum substrate, depending on the method for processing. Moreover, the material of the light sensitive layer formed on the aluminum substrate is not limited to the Se-As system alloy.

We claim:

1. A method of producing a light sensitive body for use in electrophotography comprising the steps:

(a) making an aluminum substrate flat and smooth on its surface by mechanical processing;

(b) subjecting the aluminum substrate to etching treatment using an alkaline aqueous solution or an acidic aqueous solution to provide a surface having a maximum roughness of from 2.0 μm to 4.0 μm; and (c) forming a light-sensitive layer on the etched aluminum substrate.

2. A method according to claim 1, wherein the substrate is etched with aqueous potassium hydroxide.

3. A method according to claim 2, wherein the substrate is etched with potassium hydroxide at a concentration of from 2% to 10% by weight.

4. A method according to claim 3, wherein the etching is carried out at a temperature from 20° C. to 60° C.

5. A method according to claim 1, wherein the substrate is etched with aqueous sulfuric acid.

6. A method according to claim 4, wherein the substrate is etched with 20% to 50% by weight sulfuric acid.

7. A method according to claim 6, wherein the etching is carried out at a temperature of 50° C. to 80° C.

* * * * *

UNITED STATES PATENT AND TRADEMARK OFFICE

CERTIFICATE OF CORRECTION

PATENT NO. : 4,936,948

DATED : June 26, 1990

INVENTOR(S) : Ohki et al.

It is certified that error appears in the above-identified patent and that said Letters Patent is hereby corrected as shown below:

Title page, following Item [22] insert:

--[30] Foreign Application Priority Data

September 14, 1988 Japan 63-230658--;

Column 3, line 9, "the" should read --The--;

Column 3, line 12, after "the" (first occurrence) insert

--concentration of the toner adhering to the surface of the--;

Column 4, line 19, "10 V" should read --+10 V--;

Column 4, line 35, "H" should read --$H_2SO_4$--.

Signed and Sealed this

Fifth Day of May, 1992

*Attest:*

*Attesting Officer*

DOUGLAS B. COMER

*Acting Commissioner of Patents and Trademarks*